US005975238A

United States Patent [19]

Fuchs et al.

[11] Patent Number: 5,975,238

[45] **Date of Patent: *Nov. 2, 1999**

[54] PLATE RESONATOR

[75] Inventors: Helmut Fuchs, Weil; Joerg Hunecke, Stuttgart; Xueqin Zha, Boeblingen, all of Germany

[73] Assignee: Fraunhofer Gesellschaft zur Foerderung der angewandten Forschung e. V., Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,639

[22] PCT Filed: Feb. 23, 1996

[86] PCT No.: PCT/EP96/00751

§ 371 Date: Dec. 24, 1997

§ 102(e) Date: Dec. 24, 1997

[87] PCT Pub. No.: WO96/26331

PCT Pub. Date: Aug. 29, 1996

[30] Foreign Application Priority Data

Feb. 24, 1995 [DE] Germany ..... 195 06 511

[51] Int. Cl.[6] ..... E04B 1/82

[52] U.S. Cl. ..... 181/295; 181/286; 181/290

[58] Field of Search ..... 181/207, 208, 181/209, 210, 284, 286, 287, 290, 294, 295, 224

[56] References Cited

U.S. PATENT DOCUMENTS

| | | | |
|---|---|---|---|
| 3,056,707 | 10/1962 | Helbing et al. | 181/290 |
| 3,215,225 | 11/1965 | Kirschner . | |
| 3,819,010 | 6/1974 | Adams et al. . | |
| 4,468,431 | 8/1984 | Okey . | |
| 4,709,781 | 12/1987 | Scherzer | 181/290 |
| 4,787,473 | 11/1988 | Fuchs et al. . | |

FOREIGN PATENT DOCUMENTS

| | | |
|---|---|---|
| 0 510 974 | 10/1992 | European Pat. Off. . |
| 74 27 551 | 11/1976 | Germany . |
| 31 50 116 | 9/1982 | Germany . |
| 31 41 366 | 4/1983 | Germany . |
| 35 04 208 | 8/1986 | Germany . |
| 94 00 092 | 4/1994 | Germany . |
| 510109 | 7/1939 | United Kingdom . |
| 1016432 | 1/1966 | United Kingdom . |

OTHER PUBLICATIONS

*Rundfunktechnische Mitteilungen*, vol. 36, No. 1, Jan. 1, 1992, pp. 1–11 entitled "Zur Absorption Tiefer Frequenzen in Tonstudios" by H.V. Fuchs.

*Architektenblatt* 22 (1990), pp. 1129–1132, entitled Schallschutz: Schallabsorber für einen breiten Frequenzbereich by H.V. Fuchs, U. Ackermann, N. Rambausek.

*Bau–und Raumakustik*, pp. 409–420, Table 7. Schallabsorptionsgrade von Plattenschwingern, Loch–und Schlitzplattenschwingern, by W. Fasold, E. Sonntage, H. Winkler.

(List continued on next page.)

*Primary Examiner*—Khanh Dang
*Attorney, Agent, or Firm*—Evenson, McKeown, Edwards & Lenahan, PLLC

[57] ABSTRACT

The invention concerns a plate resonator for absorbing sound and including a thin front plate with high elasticity and low internal friction, e.g., made of metal; a back plate which likewise has high elasticity but which has high internal friction; an all-over solid connection between the front and back plates in the form of a bonded connection (e.g. double-sided adhesive tape); and a border which is closed all around by the back plate but does not prevent sound entering the back plate from the side.

21 Claims, 12 Drawing Sheets

OTHER PUBLICATIONS

*Verlag Tribüne*, Berlin 1989, pp. 204–229, entitled Absorption–sschalldämpfer by K. Biehn and S. Gruhl.

*Verlag Tribüne*, Berlin 1984 entitled Schallabsorber und ihr Einsatz in Wohn–und Gesellschaftsbauten by W. Fasold, pp. 910–925.

*Das Musikinstrument* 42 (1993), Issue 8, pp. 40–46, entitled Der Raum spielt mit bei tiefen Frequenzen by H.V. Fuchs and J. Hunecke.

*Rundfunktechnische Mitteilungen* 30 (1986), Issue 6, pp. 257–268 entitled "Zur Messung von 'Nachhallzeiten' bei Geringer Eigenfrequenzdichte" by J. Oelmann and X. Zha.

Cremer, L.; Müller, H.A. entitled Die wissenschaftlichen Grundlagen der Raumakustic, vol. 1, Hirzel Verlag, Stuttgart, 1978, p. 310.

*Sonderdruck aus Bauphysik* 16 (1994), Issue 3, pp. 69–80 entitled "Transparente Vorsatzschalen als Schallabsorber im Plenarsaal des Bundestages" by H.V. Fuchs and X. Zha.

*VDI Berichte* 938 Düsseldorf: *VDI–Verlag*, 1992, pp. 187–196, entitled Resonanz–und Dämpfungsmechanismen in Membran–Absorbern by J. Hunecke and X. Zhou.

PLATE RESONATOR

BACKGROUND AND SUMMARY OF THE INVENTION

The present invention relates to a plate resonator for wide band damping in rooms, e.g., enclosed, relatively small rooms, e.g., 4×5 $m^2$ and 3 m high.

Sound damping measures in enclosed rooms have hitherto served primarily two completely different goals: (1) that of obtaining the best possible transmission between the sound source and the listeners ("room acoustics"), and (2) the least possible influence of the sound sources on the affected workplaces ("noise control").

In the first instance, the aim is to allow sound to occur as naturally, unaltered and effectively as possible, whereas in the second instance the aim is to change the noise spectrum of sound as much as possible-provided its volume can be sufficiently reduced. In addition to these traditional fields of activity for acoustic experts, there is a third domain increasingly attracting the attention of builders and planners: (3) the inverse effect of small rooms on sound (in particular at low frequencies) and the related detrimental effects of a very different nature on especially high-quality workplaces.

Poor intelligibility of speech and major sound distortion can greatly negatively affect the working conditions of, e.g., speakers, musicians, teachers and sound engineers. This inverse effect of some rooms makes it very difficult for musicians playing together to hear and control themselves, thus forcing them to play louder. In small, improperly damped rooms, e.g., vaulted basements, (but also partially roofed orchestra pits), the sound level can build up to a hearing-impairing volume level far above 100 dB(A).

In the transmission function of a rectangular, e.g., 5×4×3 $m^3$ room in an undamped, unfinished state of construction exposed to constant airborne noise excitation there are volume differences of up to 40 dB between the maximum and minimum at any point of emission or reception. If one takes into consideration that in a real situation the transmission function of a room, as depicted in FIG. 1 covering a bass instrument, it becomes evident that a room can interfere considerably if its natural resonance is ignored. As non-uniform as the frequency dependence of an entire room is, the spatial distribution of the intensity of the sound field at a specific frequency is just as uneven (cf. FIG. 2). However, the fade away behavior of a room during an emission break at frequencies between two resonance peaks is perceived by sensitive ears as very unpleasant vibrations. Sound altering "distortions" ranging from the familiar "droning" of speech or music make the work of demanding artists and sound engineers all too frequently unnecessarily difficult.

This problem, however, is also widespread, in a less intense form, in auditoriums, conference rooms, and living rooms if they are only sparsely furnished. Only in these cases, however, users with lesser schooled ears are often unable to articulate the reason for their discomfort in such rooms. The fact that in some rooms a thin layer of, e.g., mineral fibers, has been installed, with the best of intentions, behind perforated plates on parts of the ceiling, does not solve the problem. Retrofitted mounting of structured high-resilient foam boards is also not really successful and sometimes even intensifies the problem at low frequencies.

Thus, a sound-absorbing multi-layer board having holes on the front side with a hole/surface ratio of at least 5% is known from German Patent document DE 74 27 551 U1. Sound absorbing plastic foam is arranged behind this multi-layer board. Furthermore, a similar arrangement having an internal layer of gypsum board or an asbestos board is known from U.S. Pat. No. 3,215,225. However, the front plate is also partially designed in a reflecting manner with a damping coat similar to an antidrone coat in passenger vehicles.

DISADVANTAGES OF CONVENTIONAL SOUND ABSORBERS

In the construction of sound studios, it has been customary for some time to build in, if needed, special bass absorbers in recording and replaying rooms. However, hitherto they are quite space-consuming and demand the use of a good deal of synthetic mineral fibers (KMF). It is still relatively expensive and very space-consuming to obtain the necessary sound absorption at low frequencies using the known "coffered ceilings", "bass traps" and "edge absorbers" (see Fuchs, H. V.: On absorption of low frequencies in sound studios. Broadcasting Technology Reports 36 (1992), issue 1, pp. 1–11). Instead of smooth transitions corresponding to the respective architectural design, these absorbers virtually project from the wall or ceiling. Retrofitted improvements usually also resort to rather bulky "corner stands". Work and development is being done on various alternative/fiberfree absorbers for acoustical sound control (see Fuchs, H. V.; Ackermann, U.; Rambausek, N.: Sound protection: sound absorber for a broad frequency range. German Architect Report 22 (1990), issue 7, pp. 1129–1132). The so-called "membrane absorber" according to FIG. 3 can already alleviate some of the drawbacks of conventional absorbers in that (1) it does not require the use of possibly health hazardous KMF (synthetic mineral fibers), (2) with a structural depth of only 100 mm, it can be tuned, e.g., to frequencies below 100 Hz, (3) it is distinguished by a completely hermetically closed construction, (4) with completely smooth surfaces on all sides and with internal honeycomb structures, it can be manufactured from a single material, e.g. steel or aluminum, and (5) as a solid, independent component it can be utilized in a very mobile and versatile manner.

However, in numerous acoustical uses, the MA (membrane absorber according to U.S. Pat. No. 4,787,473) also revealed distinct drawbacks. For example, (1) its relatively narrow band effectivity tuned to low frequencies requires in many cases mounting additional porous or fibrous absorbers adjacent to, or in front of, the MA for damping medium or high frequencies, (2) its autonomous, compact, angular construction does not permit fitting it into every architectural concept, and (3) it is very expensive to manufacture compared to conventional acoustical wall or ceiling cladding.

Most acoustical uses do not exploit the unusual sturdiness of MA due to its peripheral "frame", its (one-sided version) "trough" on its rear side and its internal "honeycombs". On the other hand, it is frequently preferred to let the absorbers be hidden behind a large-area, wallpapered surface (e.g. also as a "front"). For some architects and builders, the projecting bass absorbers look too technical.

Conventional resonators used as sound absorbers, including the so-called foil, membrane and plate resonators (cf. e.g. Table 7, pp. 409–420 in (Fasold, W.; Sonntag, E.; Winkler, H.: Acoustics of Buildings and Rooms, Building Publishers, Berlin, 1987.)) often have a more or less plane surface. However, the boards made of, e.g., wood chip, wood fiber, plywood or gypsum plaster board, are usually mounted on a subconstruction of wooden strip beams, which naturally always "work" a bit. For this reason, such "paneling" can be painted but not wallpapered to last. The prevailing opinion (cf. p. 207 in: Biehn, K.; Gruhl, S.; Absorption sound damper. In: Combating Noise, Ed. W. Schirmer, Tribune Publishing, Berlin 1989) is that sound damping is determined by internal losses at and near the resonance frequency defined by the mass of the plate and the spring rigidity of the air cushion enclosed between the plate and the reverberant rear wall. According to this widely accepted opinion, additionally placing "flow resistances", e.g., in the form of a loose, porous absorber filling, in the air volume can somewhat enlarge the band width of these resonance sound dampers. Therefore, it seemed obvious to completely seal the air space, as well as for hygienic and practical reasons, more or less airtight with strips or frames.

With regard to this, Fasold, W.: Sound absorbers and their use in residential and commercial buildings, Acoustic Paperback, Part II., ed. W. Fasold et al., Technology Publishing, Berlin 1984, explicitly states:"The degree of sound absorption at the resonance frequency is about 0.5 to 0.8, in air space without damping material it is only 0.3 to 0.5. A prerequisite is that the plate can really vibrate freely; therefore the damping material must not be stuffed between the wall and the plate . . . Coffering the air volume has a favorable effect, because it prevents the propagation of sound in the air space."

The object of the present invention is to create a plate resonator that is easy to build and does not require synthetic mineral fibers. This object is achieved according to the invention by the plate resonator described herein. Some advantageous uses are also described herein and advantageous embodiments are described as well.

The present invention provides a plate resonator for acoustical damping and sound insulation including a thin front plate made of metal, a rear board made of a polymer, e.g., polyurethane or polyethylene, a whole surface firm connection between the front plate and the rear board as an adhesive connection, for example, a double-faced adhesive tape. A border is provided which is closed on all sides by the rear board and does not impede lateral entry of sound into the rear board. Advantageously, the plate resonator can be utilized as a wall element, an element suspended in a room, or as a room partition.

FEATURES OF THE NEW SOUND ABSORBER

In the following the present invention is made more apparent using FIGS. 1–15, with FIGS. 1–3 depicting the state of the art.

DETAILED DESCRIPTION OF THE DRAWINGS

Figure 4A:
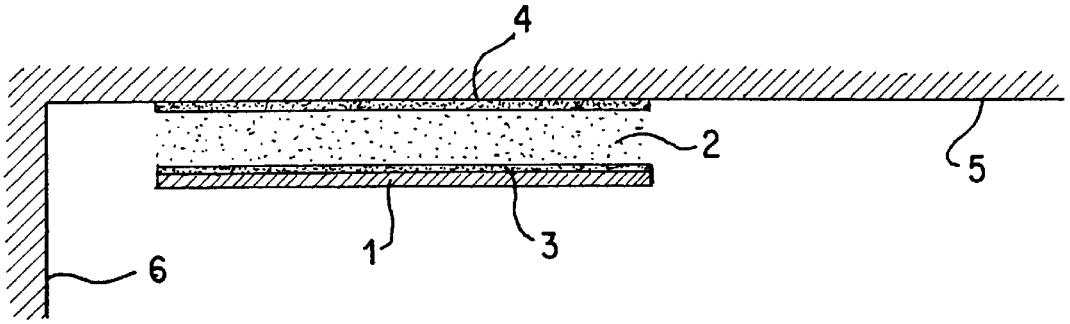
FIGS. 4*a* and 4*b* are diagrams of a composite plate resonator for wide-band sound damping of small rooms where reference number (1) indicates a freely vibrating front plate (e.g., 0.5 to 2 mm St (steel) or A1 (aluminum)), (2) a resonating porous damping layer (rear board) (e.g., 50 to 200 mm melamine resin, high-resilient foam), (3), (4) a whole surface adhesive connection of front plate and rear board and/or the rear board and an unfinished part of the building (ceiling), (5) the ceiling of the room, and (6), (7) walls of the room.
Figure 4B:
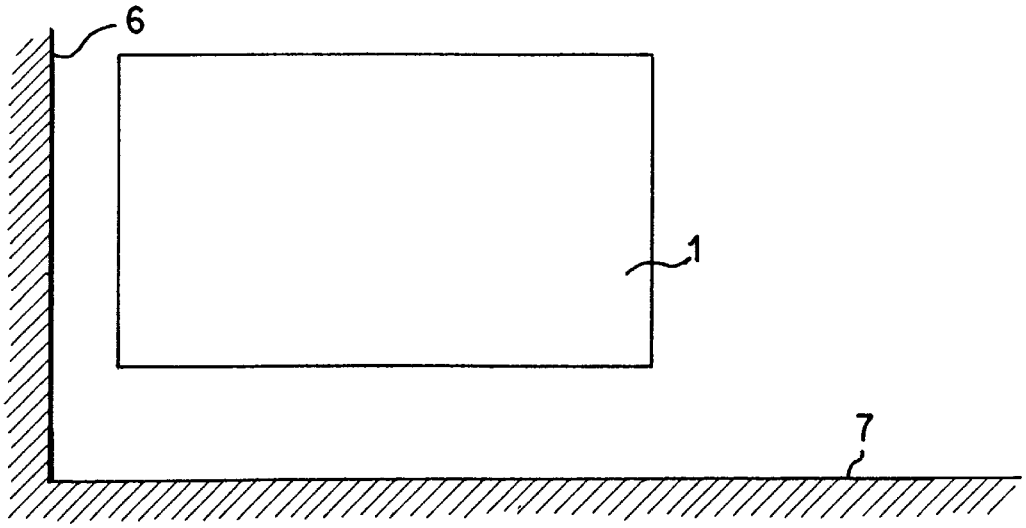

Compared to the state of the art, the invented component according to FIG. 4 does not require any encompassing frames, a trough on the rear side, a strip-shaped subconstruction, any coffering in the intermediate air space, and loose flow resistance therein.

Instead, the invented plate resonator is distinguished by having a thin front plate (1) having extremely low internal friction made of metal (e.g., 0.5 to 2.0 mm St or A1). A thick rear board (2) fills the entire space between the front plate and the unfinished part of the building and has extremely high internal friction (e.g., 50 to 200 mm of a fine-cell roamed elastomer, as utilized for vibration insulation of machines and buildings, such as polyurethane or polyethylene). A durable, whole surface, firm connection (3) is provided between the front plate and rear board in such a manner that any vibration of the front plate excited by airborne sound in the room is fully transmitted onto the rear board. Thus, both components always jointly resonate as a complex mass/spring/friction vibration system and, in this manner, draw energy from the sound field. A large area structure of homogeneous design all the way to its very edges (0.5 to 2.0 $m^2$), which is planar and parallel to the wall or the ceiling, as well as being freely elastic in its elements, can be stretched trampoline-like in the corners of the room with especially high sound energy density. The invented plate resonator also has a border that, although it is closed on all sides by the elastomer board, does not impede the lateral entry of sound into the rear board.

Figure 5A:
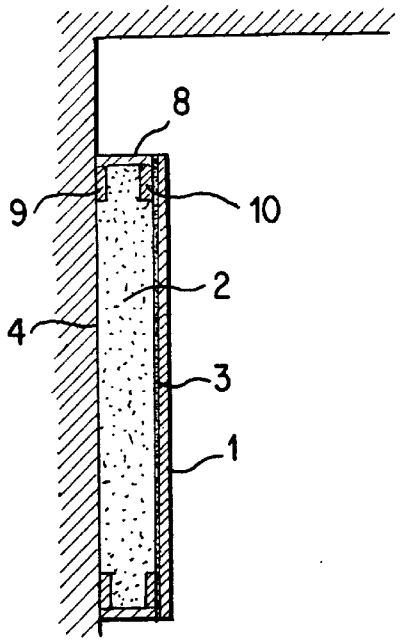
FIGS. 5*a* and 5*b* are side and front diagrammatic views of a hidden edge mounting arrangement of a composite resonator in a corner of a room.
Figure 5B:
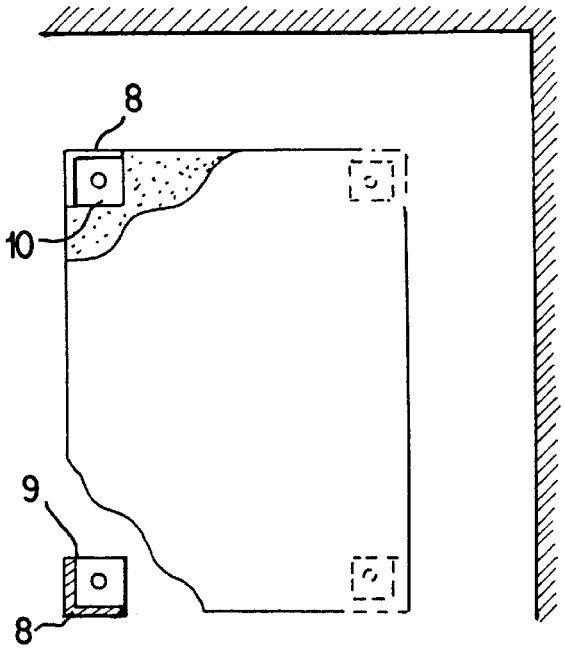
Figure 6A:
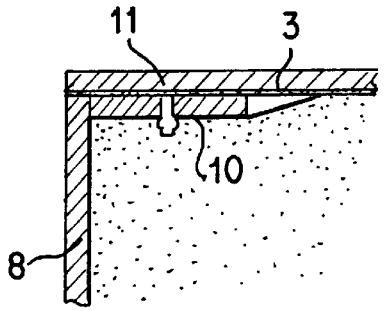
FIGS. 6*a*–6*c* illustrate a flush or screw connection between the front plate and corner moldings according to FIG. 5.
Figure 6B:
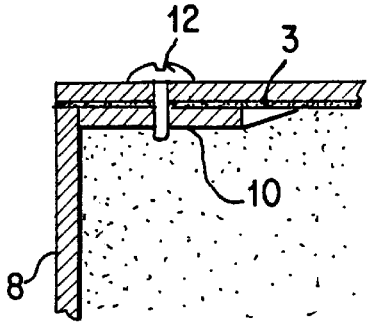
Figure 6C:
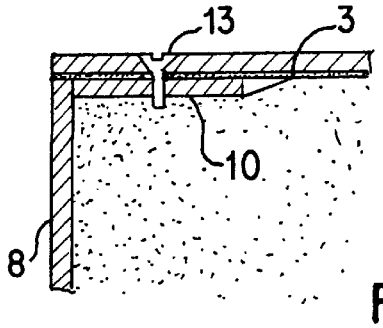
Figure 7A:
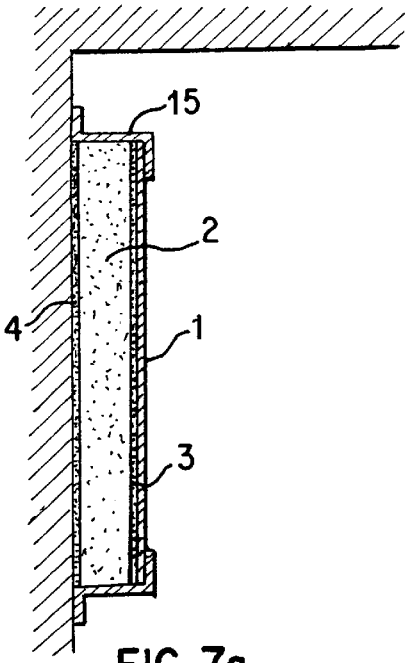
FIGS. 7*a* and 7*b* are side and front views of a visible edge mounting of a composite resonator in a corner of a room.
Figure 7B:
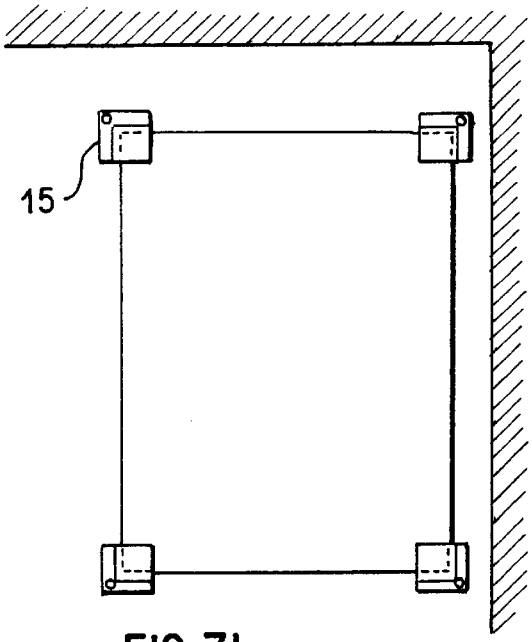

The mounting of the invented component, e.g. to the ceiling, may be at defined points (in a regular pattern), in strips or over the entire surface with the aid of an adhesive, adhesive tape or so-called Velcro® material. For mounting and dismounting as well as recycling or disposal of the invented component, it would be advantageous at any rate if the connections (3) between the front plate and the rear board, just as between the plate resonator and the unfinished part of the building component (5), can be detached at any time without difficulty in removing or disposing of residues. There are numerous materials and joining methods available from the textile and packaging industries. However, mounting elements employed for mounting facade elements (exterior) and fronts (interior) used in a variety of embodiments can be employed in such a manner that the forced resonance, adapted to the inhomogeneous sound field in small rooms, of the intimately joined front plate and rear board, is impeded as little as possible by the same. FIGS. 5*a* and 5*b* show an example of this, recommendable for wall cladding: the narrow corner rails (8), which, e.g., are dowelled in the unfinished part of the building by means of small plates (9) and which support and fix the invented component, remain hidden behind the front plate 1. Fixing the front plate can, according to FIGS. 6*a*–6*c*, e.g., be flush by means of hard rubber pegs attached to the rear side of the front plate. The pegs lock into previously prepared holes in the plates (10) of the corner moldings in the form of snaps (11). At any rate it is recommended to also place a permanently elastic layer (3) made of an elastomer between the front plate and the corner moldings. However, screwing without (12) or with (13) a certain amount of countersinking in the through holes of the front plate according to FIGS. 6*a*–6*c* is also possible. In visible mounting by means of the edges, as sketched in FIG. 7, the covering of the edges can serve as decoration. In any event, the mounting can be designed such that an interior designer or decorator is provided with a statically well-mounted, stable, smooth surface that he can paint, print, coat, cover or structure as he desires without substantially altering its acoustical properties. Thus, the sound absorber does not interfere with the construction of the interior, but rather offers additional decorative elements (e.g. as mirrors) if the component is to be mounted on a wall or to stand in the room.

ACOUSTICAL EFFECT OF THE COMPOSITE RESONATOR

Figure 8:
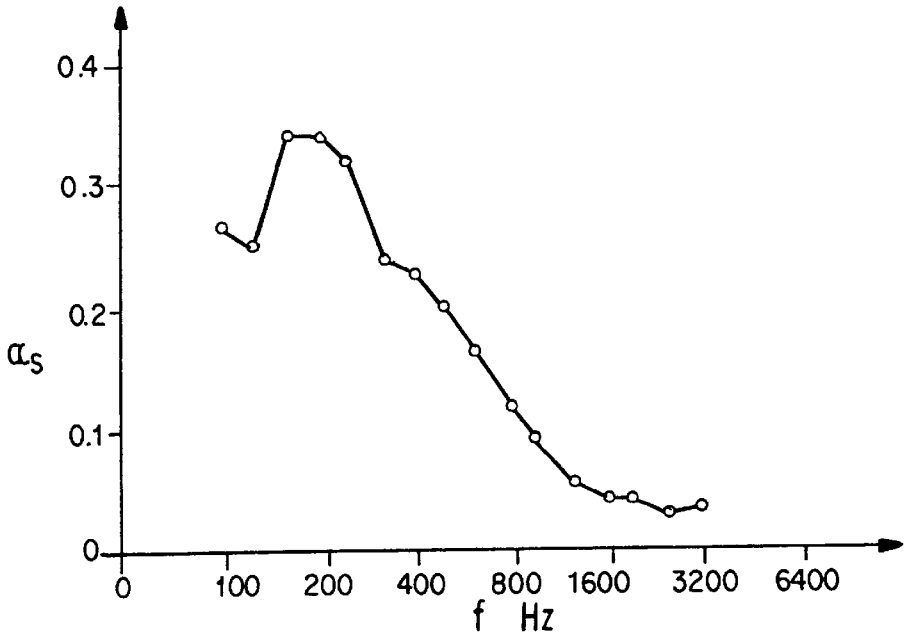
FIG. 8 is a graph of the degree of absorption $\alpha_s$ of a wooden coffered ceiling.
Figure 9:
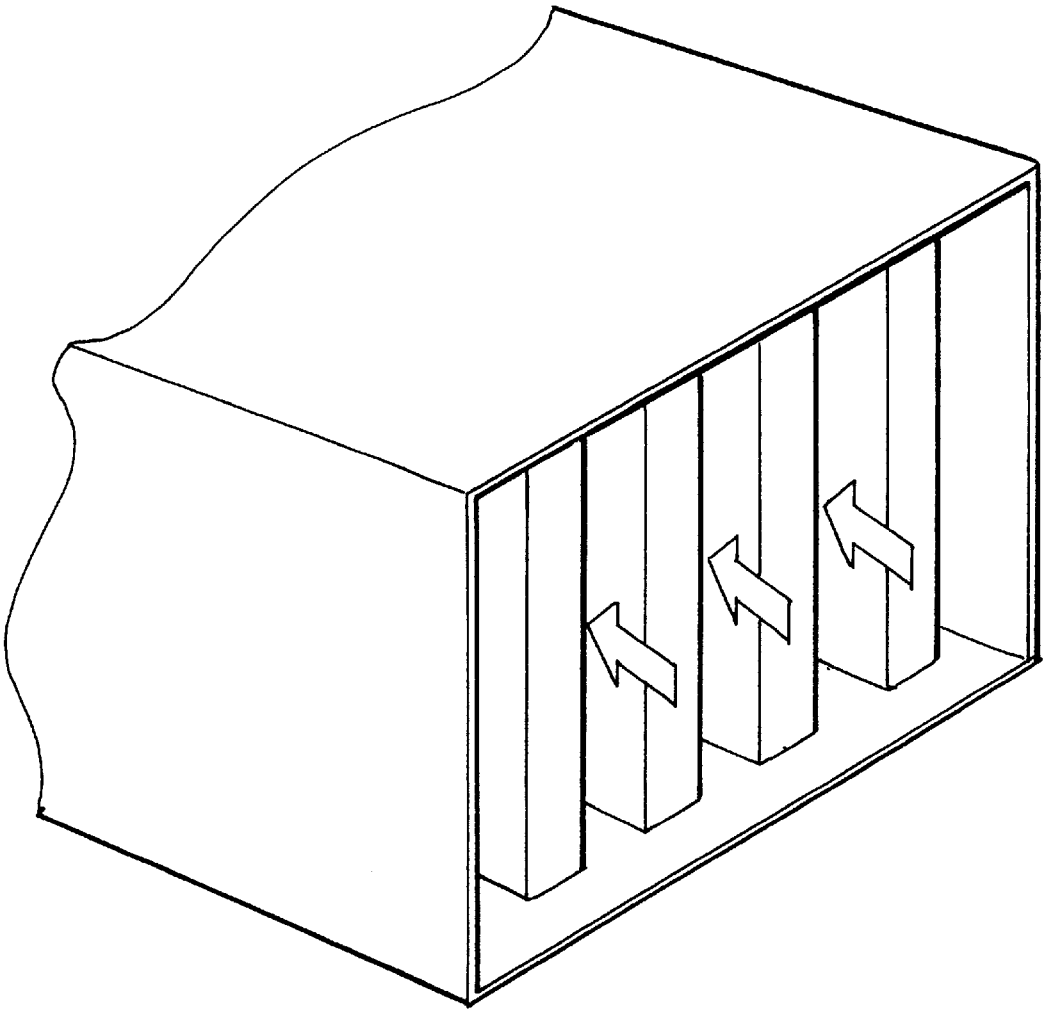
FIG. 9 is an illustration of a so-called "bass trap".

Like all sound absorbers that are excited to resonate by incident airborne sound, the invented component must also be tuned to the desired frequency range. For rooms having a volume below approximately 200 $m^3$, the frequency range from 125 to 63 or even 50 Hz is of special interest (see Fuchs, H. V.; Hunecke, J.: The room plays a role in low frequencies. The Musical Instrument 42 (1993), issue 8, pp. 40–46.). When degrees of absorption are found at all in the literature for frequencies below 125 Hz (see Table 7 in Fasold, W.; Sonntag, E.; Winkler, H.; Building and Room Acoustics, Building Publishers, Berlin, 1987), the values given are barely more than 0.6 at 100 Hz and rarely more than 0.3 at 63 Hz. There are three reasons for this. First of all, even in a normed reverberation room, unsurmountable measuring problems begin under 125 Hz which are related to the very room resonances under discussion herein, for which the so low-tuned absorbers are preferably to be subsequently utilized. Secondly, it is apparently difficult to tune plate resonators having a conventional construction so low with sufficient band width. For this reason, sometimes overly voluminous and cleaved "coffered ceilings" (FIG. 8), "bass traps" (FIG. 9) and "edge absorbers" are resorted to, whose structural depth D however should be a quarter of the wavelength λ, $$D \cong \frac{8500}{f}[\text{cm}] \tag{1}$$

with a frequency of f (Hz).

Finally thirdly, according to the present state of the art, it does not seem useful to classify the bass absorber, aimed at here, in the conventional manner by the degree of absorption measured in a diffuse as possible sound field such as in a reverberation room of DIN 52 212 specifications. A measurement, testing and evaluation method better adapted to the retrofitted arrangement in the corners or edges of a rectangular room permits much clearer assessment of the performance of these special resonance absorbers. Like in the successfully introduced method of determining the reverberation times at low frequencies (Oelmann, J.; Zha, X.: Measurement of "reverberation times" at low natural mode densities; Broadcasting Technology Reports 30 (1986), issue 6, pp. 257–268 the fading away at a microphone position in a corner of a room is determined at the different natural resonances of the room. From the difference between the, in this manner accurately measurable, fading away times $t_0$, and/or without $t_m$ with the absorbers also mounted in the corners, an absorption surface $A_e$ with reference to the component surface S (or "effective" surface) can, as customary, be defined as the "equivalent" degree of absorption $$\alpha = \frac{A_e}{S} = 0.163\frac{v}{s}\left(\frac{1}{t_m} - \frac{1}{t_o}\right) \tag{2}$$

and in this way different absorbers for this special use can be specifically compared.

Figure 1:
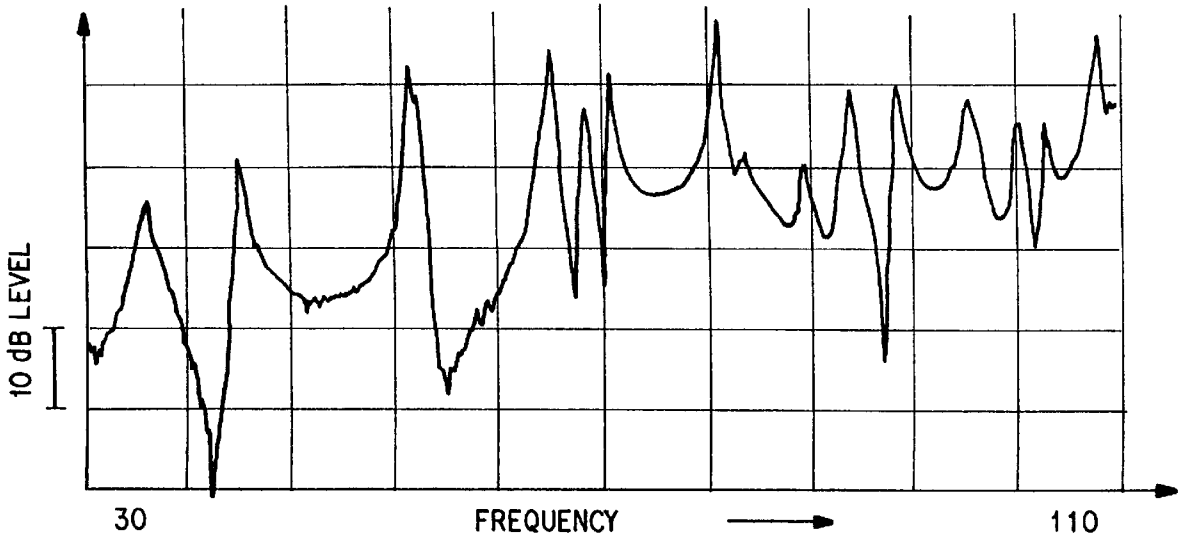
FIG. 1 is a graph of a transmission function of a rectangular, 5×4×3 $m^3$ room in an unfinished state of construction.
Figure 3:
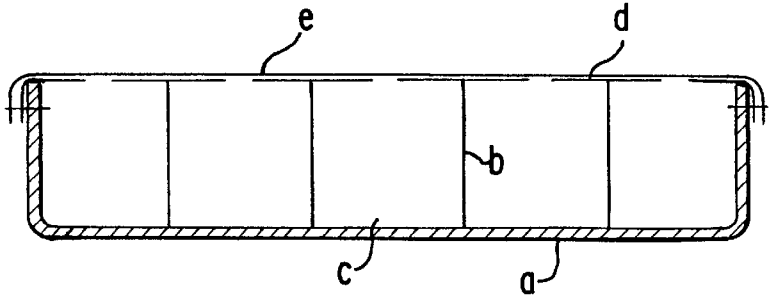
FIG. 3 is a cross-section view of a compact absorber (MA) according to German Patent document DE 35 04 208 (U.S. Pat. No. 4,787,473) comprising: a rear wall or a trough; a honeycomb or coffered structure; hollow chambers filled only with air; a hole membrane capable of vibrating; and a cover membrane capable of vibrating.
Figure 2A:
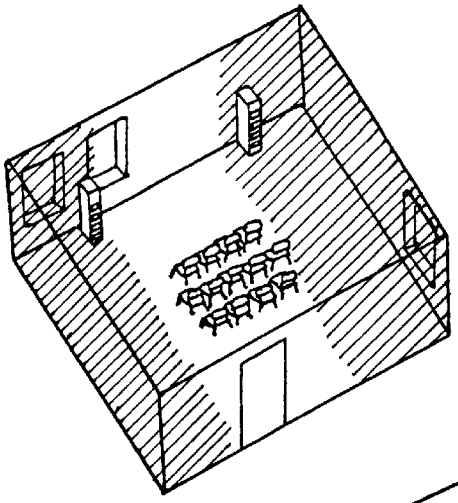
FIG. 2a PRIOR ART
FIGS. 2*a*–2*e* indicate, via the blackened area, the distribution of the sound pressure of a rectangular room, 7.1×6.2×2.3 $m^3$.
Figure 2B:
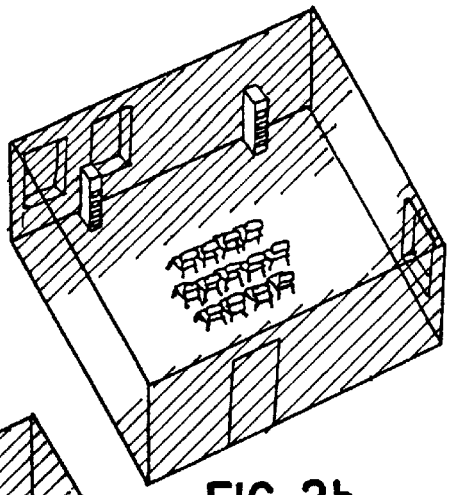
FIG. 2b PRIOR ART
Figure 2C:
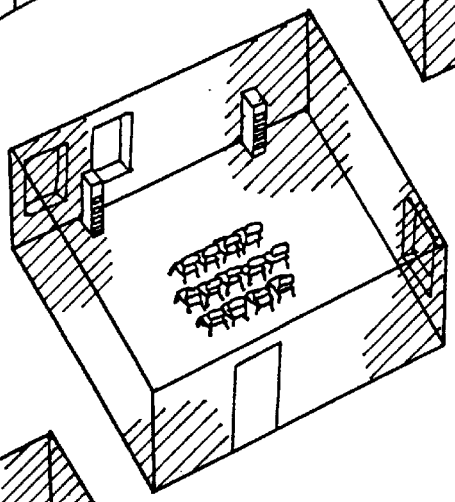
FIG. 2c PRIOR ART
Figure 2D:
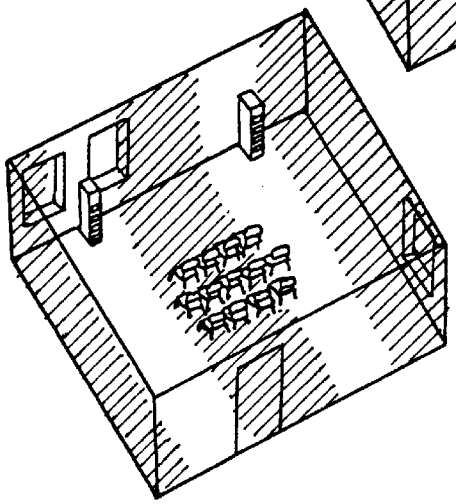
FIG. 2d PRIOR ART
Figure 2E:
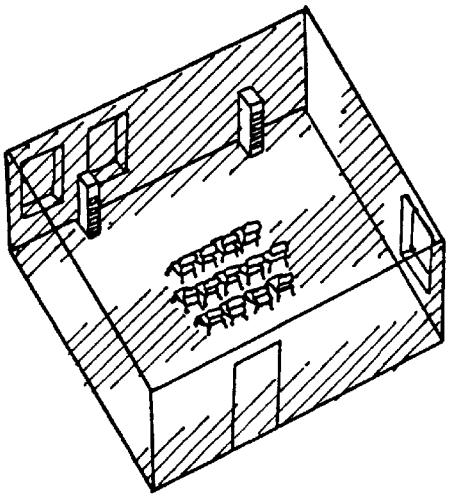
FIG. 2e PRIOR ART
Figure 10:
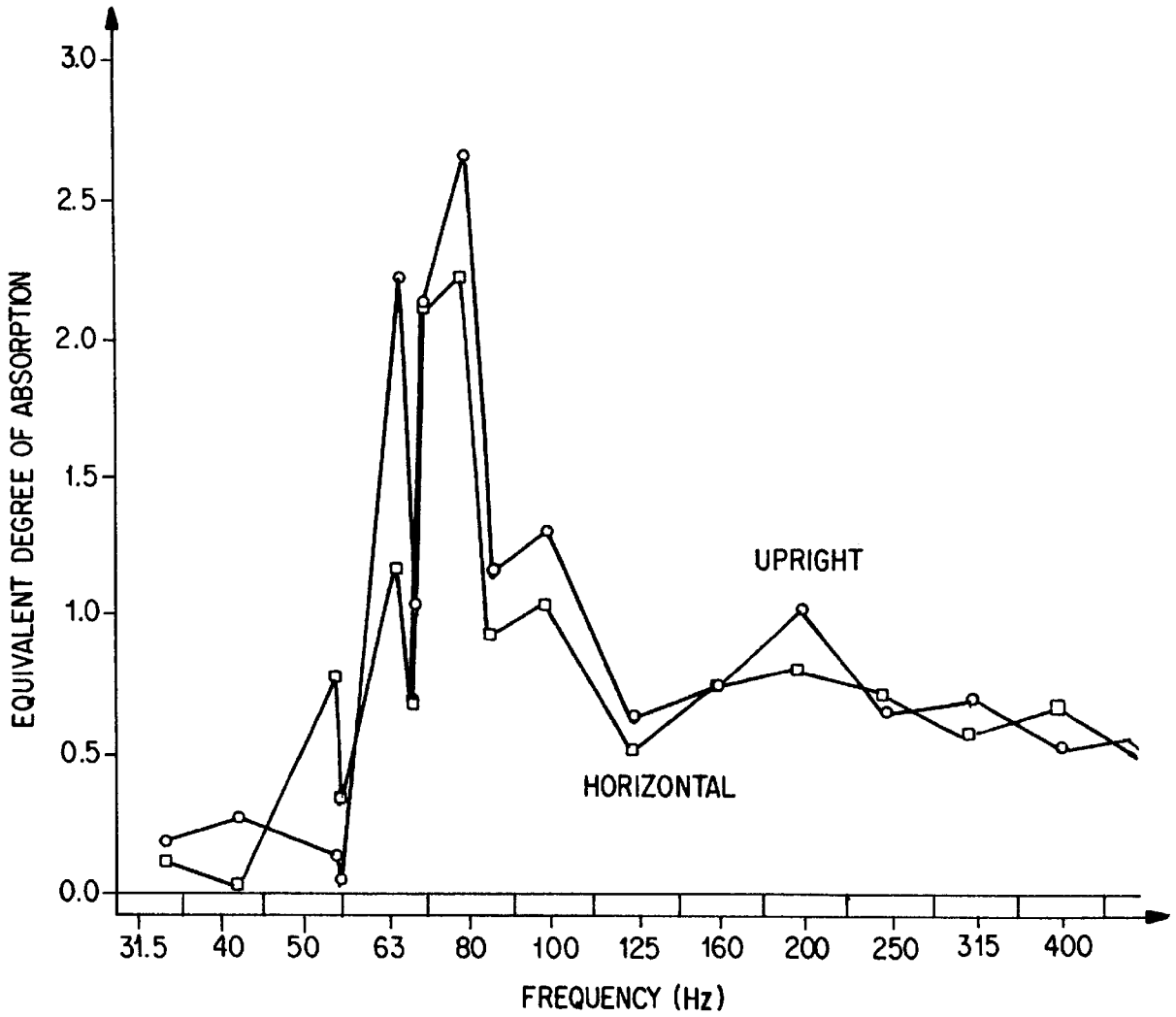
FIG. 10 is a graph of an equivalent degree of absorption of a prototype of the invented component, each component having a single surface of 1.4 $m^2$ respectively, disposed in the 4 corners of a room.
Figure 11:
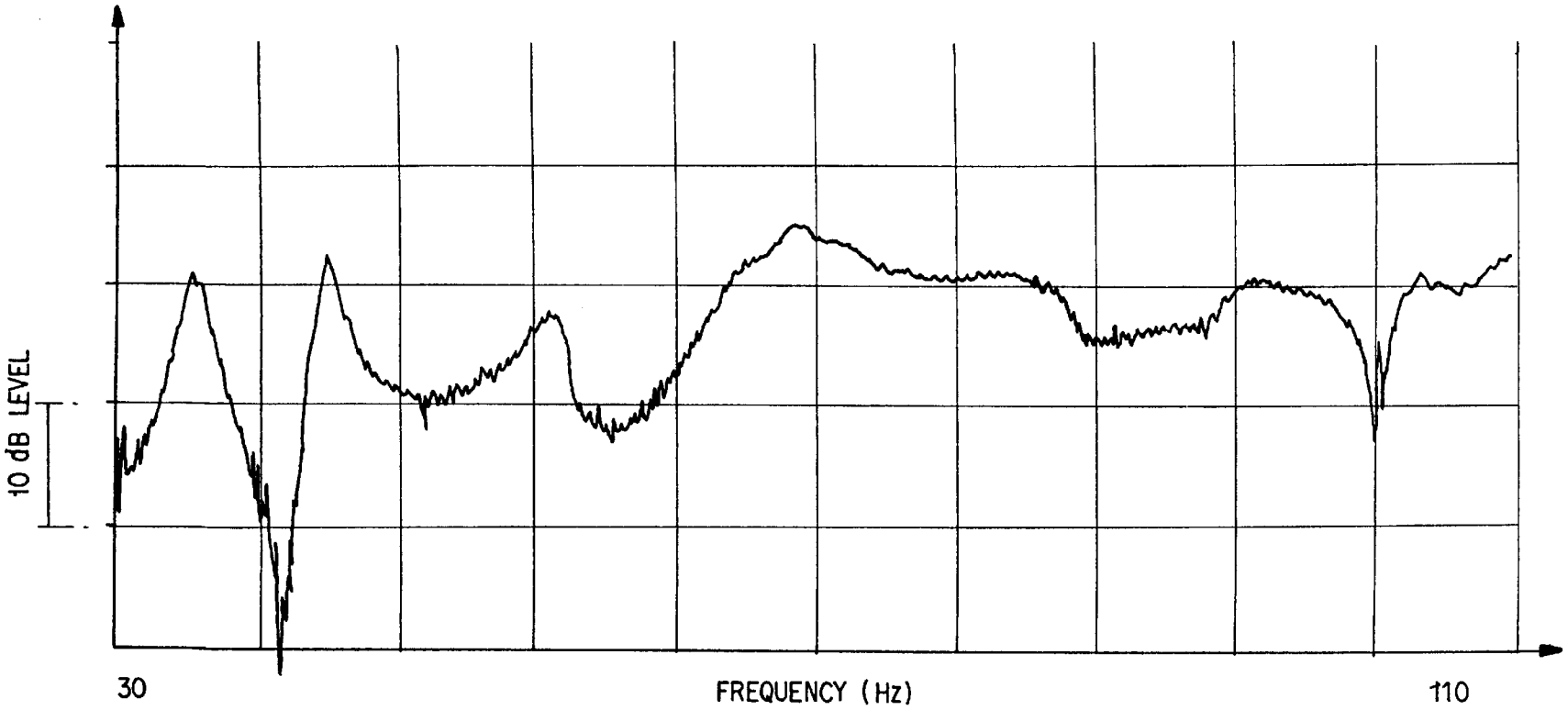
FIG. 11 is a graph of the transmission function of a room as in FIG. 1 following the mounting of six plate resonators, each having an area of 1.4 $m^2$ respectively, in its corners.
Figure 12:
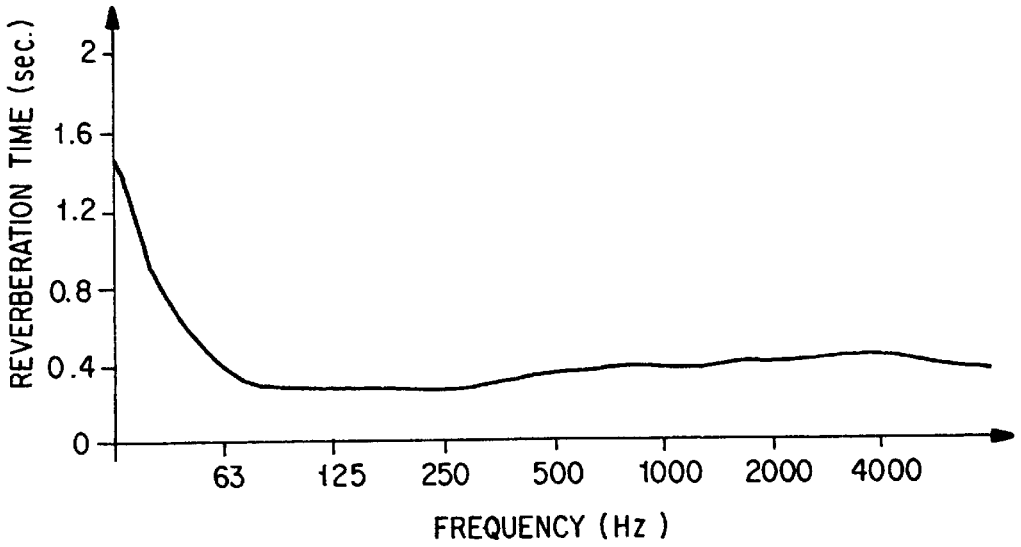
FIG. 12 is a graph of the reverberation time of a sound studio with 30% ALFA (alternative fiber free absorber) cladding.

FIG. 10 shows an example of such an $\alpha_e$ measurement: from 100 Hz upwards measured with tertiary noise and below 100 Hz with sinus excitation at the natural resonances (down to 35 Hz). If only about 10% of the entire room boundary surface in the corners and edges is covered with this prototype of the invention, its transmission function (cf. FIG. 1) according to FIG. 11 can be leveled to barely more than 10 dB level fluctuation below 100 Hz. The invented component offers a very effective means of preventing and/or eliminating "droning" in small rooms. FIG. 12 shows the reverberation time of a sound studio which has been optimized using various prototypes (all having a structural depth of only 100 mm and a basis weight of 7–20 $kg/m^2$: with room occupancy of approximately 30%, the reverberation time does not begin rising to somewhat higher values until below 63 Hz.

SPRING/MASS SYSTEM WITH CONCENTRATED ELEMENTS

The plate or panel resonator according to table 7 in Fasold, W.; Sonntag, E.; Winkler, H.: Acoustics of Buildings and Rooms, Building Publishers, Berlin, 1987 is found in use in many concert halls as a "bass absorber". According to Cremer, L.; Muller, H. A.: The scientific basis of room acoustics, Vol. I, Hirzel Publishers, Stuttgart (1978) (§§29 to 31), its resonance frequency can be reliably estimated using:

$$f_o = \frac{c_o}{2\pi}\sqrt{\frac{\rho_o}{\rho_r \cdot t \cdot D}} \cong \frac{600}{\sqrt{m'' D}}\,[\mathrm{Hz}] \tag{3}$$

with $c_0$; $p_o$ being the velocity of sound and the density of the air in the intermediate space of the thickness D(cm) between the plate having a thickness of t, the density $S_t$ and the basis weight m" (kg/m$^2$). One knows that the internal friction of the plate which is deformed in the vicinity of the mounting edge is not sufficient to obtain any useful absorption. However, how high and wide the absorption actually is due to the at least partial "back filling" of the air space with "absorbing material" in which the movement of the air is damped by the shearing forces in the interfaces of the pore or fiber structure, which is assumed to be rigid, always remains to be measured, preferably in the reverberation chamber. With regard to this, in Fasold, W.: Sound absorbers and their use in residential and commercial buildings, Acoustic Paperback, Part II., ed.W. Fasold et al., Technology Publishing, Berlin 1984 on page 921 says: "The multiplicity of influences on sound absorption due to, in particular the type of attachment (of the plate) makes dimensioning of plate resonators somewhat uncertain. Therefore, it is recommended to rely on measured results." (cf. Table 6.29 therein). Moreover, reflections such as those in No.7 in Fuchs, H. V.; Zha, X.: Transparent temporary baffles as sound absorbers in the plenary hall of the German Federal Parliament. Physics of Building 16 (1994), issue 3, pp. 69–80 have always come to the conclusion that, in order to obtain small characteristic impedance and therefore large band width, relatively light plates and a large structural depth were inevitable at low frequencies. The membrane absorber, described in No. 7.2, with the additional Helmholtz resonance following below the plate resonance according to equation (3) tried to solve this dilemma with some success. Relatively heavy hole and cover membranes also permitted the development of rather wide-band sound absorbers (see Hunecke, J.; Zhou, X.: Resonance and damping mechanisms in membrane absorbers. Reports of the German Engineering Society 938, Düsseldorf: German Engineering Society Publishing, 1992, pp. 187–196). However, also the membrane absorber with its relatively narrow coffering continued to adhere to the locally effective spring/mass system of concentrated mass and air spring. However, in the above reference it already became clear that the cover membrane, by adapting to the geometry of the coffering, can also be excited in its resonant frequencies.

ADAPTED VIBRATION OF FREE MOVING FRONT PLATES

If the dimensions of the plates are in the range of 1 to 2 m, the front plate can "adapt" to a certain extent with its vibrations to the spatial and temporal structure of the modes of the room and therefore due to its all round free movement optimally deform and resonate. This forced resonance is, of course, strongest in the corners and in the edges of rectangular rooms in which the airborne sound energy strongly concentrates at the low frequencies of the lowest characterizing modes of the room. A front plate that, at most, is supported by its 4 corners lies so low (at any rate under 10 Hz) with its lowest resonant frequency of $f_{1.0}$ according to Hunecke, J.; Zhou, X.: Resonance and damping mechanisms in membrane absorbers. Reports of the German Engineering Society 938, Düsseldorf: German Engineering Society Publishing, 1992, pp. 187–196 that any room mode between 50 and 100 Hz finds adjacent plate modes with which it can vibrate jointly. For plates that are supported by two opposite edges at a distance of L, the equation in Cremer, L.; Muller, H. A.: The scientific basis of room acoustics, Vol. I, Hirzel Publishers, Stuttgart, 1978:

$$f_1 = 0.45\frac{c_L h}{L^2}$$

with the longitudinal wave velocity $C_L$ in the plate material, provides a reference value for the base frequency of the plate, for 2.5 mm steel and L=1 m with $c_L$=5.100 m/s thus, e.g., $f_1$=6 Hz. By coupling these plate vibrations with an intermediate air space to the wall or to the ceiling, excitation of the plate becomes quite difficult. However, even without computation, one can very well imagine that only a back filling with loose flow resistance will hardly suffice to damp their vibrations. Instead, much more massive damping measures have to be resorted to for such heavy plates.

RESONATING REAR BOARD

Just as metal sheets, e.g., in car body construction, excited by structure-borne noise are damped with an elastic viscous ("antidrone") coat, it is conceivable to absorb the vibrations of the front plate generated by airborne sound with a somewhat thick, e.g., bituminous, coat. However, the present invention goes one step further: it replaces the entire intermediate air space with a resilient as well as damping elastomer board, which reduces the resonance frequency with its, compared to air, lower sound velocity $C_D$ according to equation (3). However, simultaneously its greater density $p_D$ acts in the same equation in another direction:

$$f_D = \frac{C_D}{2\pi}\sqrt{\frac{\rho_D}{\rho_t D t}} \tag{5}$$

The rear board however not only acts as a naturally resilient element with high "internal" (visco-elastic) losses, but also with an all around open access of the airborne sound waves, as a practically rigid (in relation to the airborne sound) but open-pore structure with, as is commonly known, high "external" friction in the developing unstationary shear layers.

According to the various effective mechanisms, three strong damping effects can be typically seen in the absorption spectrum of FIG. 10, which was determined using a measurement method custom-designed for this special problem.

For a 0.8 mm thick steel front plate in combination with a 100 mm thick PU (polyurethane) foam board, the maximum effect lies, approximately according to equations (3) and (5), between 50 and 100 Hz.

Figure 13:
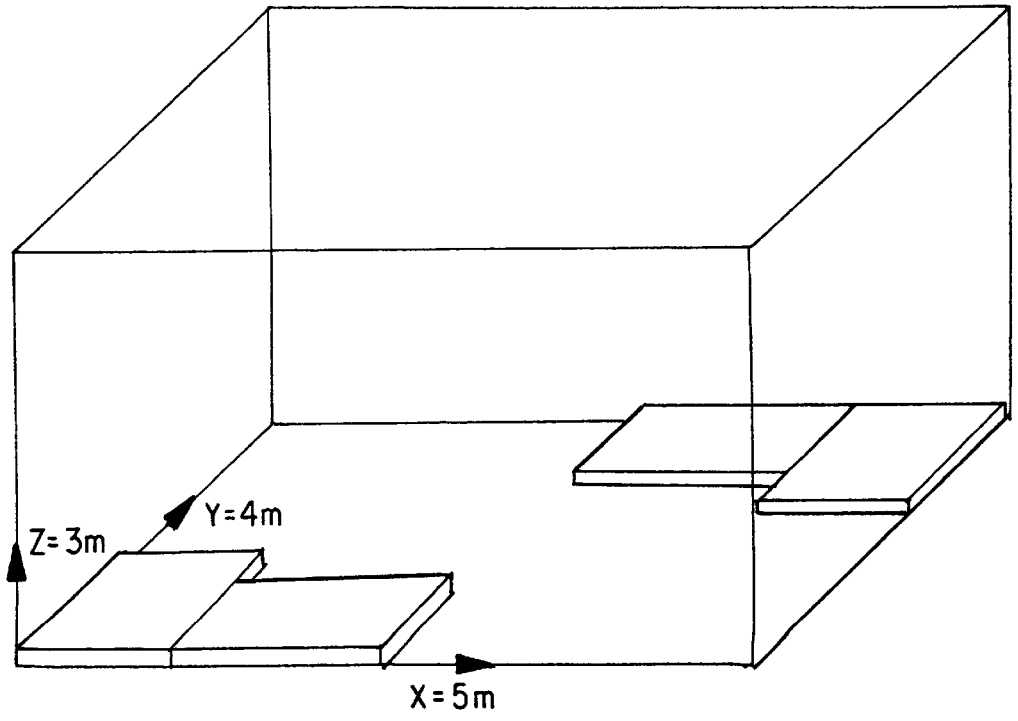
FIG. 13 is an illustration of prototypes of the plate resonators disposed in a "horizontal" manner according to FIG. 10.

For even heavier front plates, this maximum shifts tendentiously to even lower frequencies, but only obtains somewhat smaller values for the equivalent, with reference to the surface of the component, absorption surface according to equation (2). It is of little significance in which corner of the room the absorber is erected or whether, as indicated in FIG. 13, it is disposed horizontally (and/or attached to the ceiling accordingly).

Particularly strong absorption peaks occur in the individual room resonances. Values far above 1 (up to a maximum of 2.5) are not unusual, because the absorbers are not placed evenly at all of the interfaces of a diffuse reverberation field but rather are intentionally placed where they can develop their maximum effectivity. Moreover, the resonance absorbers not only affect the room modes dissipatively, i.e. in a damping manner, but also reactively, i.e. detuning the natural resonance. The resonances of the hollow space and the composite board form together new, but now greatly damped, large-area coupled vibrations. Therefore, the equivalent absorption is, as the reverberation measurements according to equation (2) show, also especially strong if two resonant frequencies lie close together.

Above about 100 Hz, FIG. 10 also shows an absorption far above 0.5 to 1, which can not be explained by the resonance of the composite board. Although the frontally colliding sound waves actually should be completely reflected at high frequencies by the composite board, the defined extension and the all around open construction of the invented component ensures that sound waves at medium frequencies (between about 100 and 1000 Hz) reach into the rear board due to diffraction and are converted there into heat, like in a conventional passive absorber. This effect can still be very advantageously exploited in the invented component even if, in the case of a completely enclosed wall or ceiling cladding, narrow (about 50–100 mmm wide) strips of an open-pore material having the same structural depth as the invented component are inserted between the differently tuned invented components creating a planar, enclosed chessboard-like arrangement, as, e.g., shown in FIG. 13. Thus, the reverberation, time of a room can be set selectively frequency-dependent, e.g., like in FIG. 12. The invented component therefore is a wide band absorber with variable frequency characteristics for very different uses.

Figure 15A:
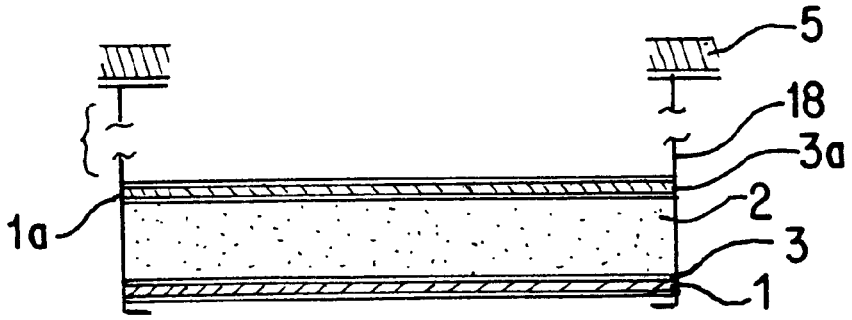
FIGS. 15*a*–15*d* illustrate a further development without a rigid rear wall as a mass/spring system 2 with an additional high-resilient foam layer 101, the plate resonator in a trough 110, with both plates 1 and 1*a* arranged in a "floating" manner, and with a non-woven cover 120 with a floating plate and a plate 1*a* lying on top of the trough.
Figure 15B:
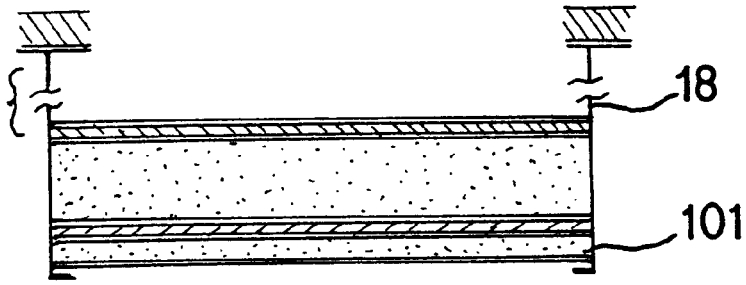
Figure 15C:
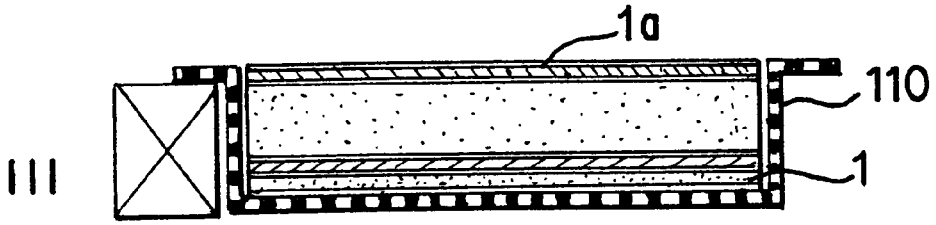
Figure 15D:
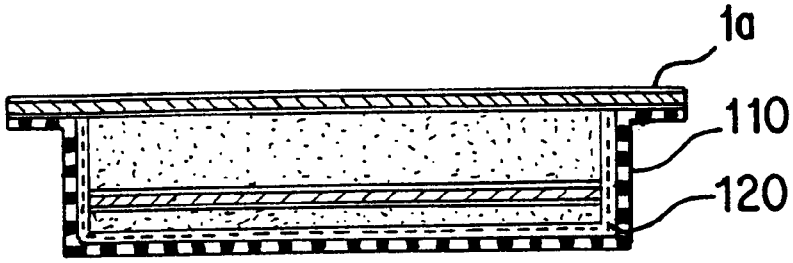
Figure 16:
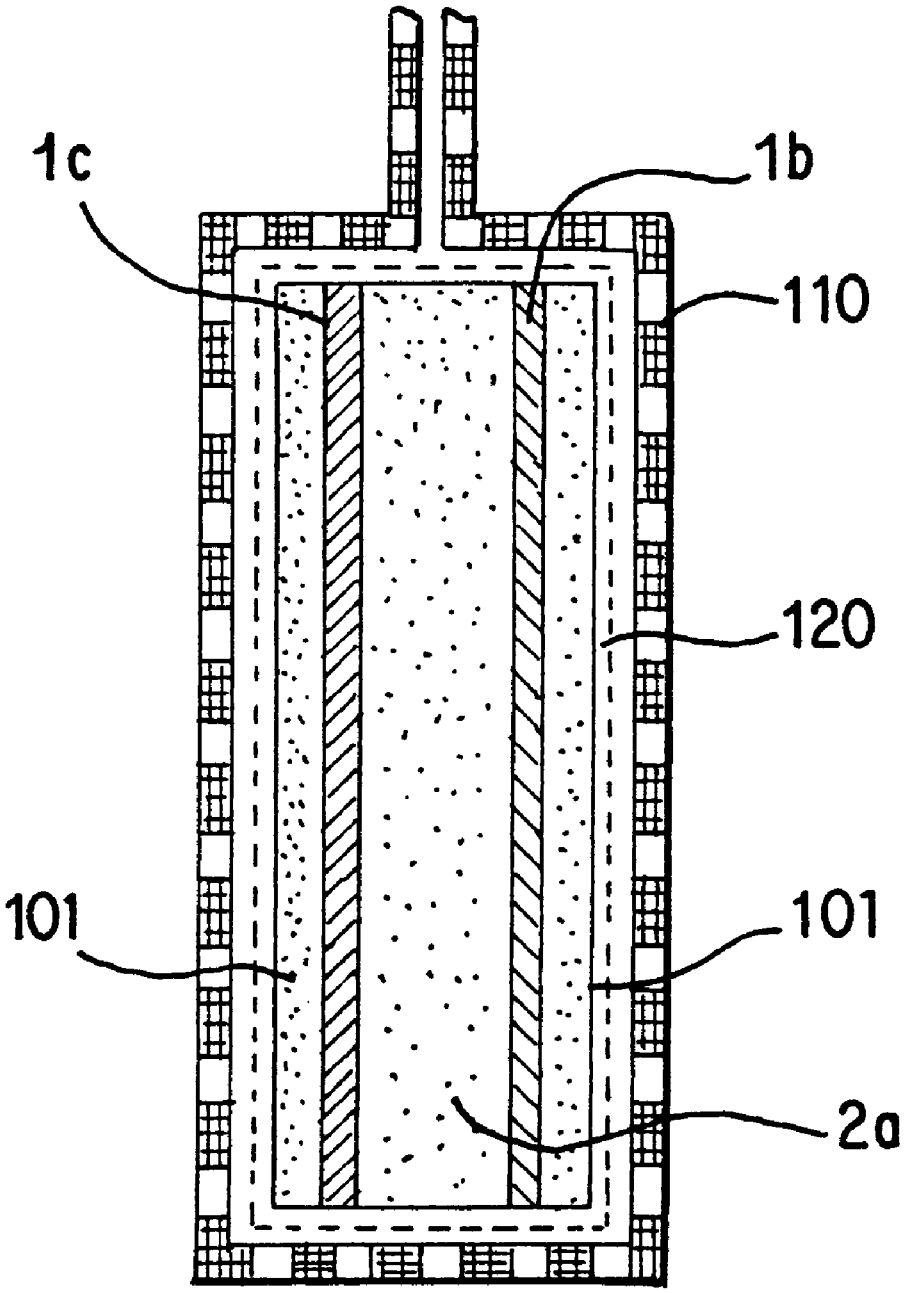
FIG. 16 illustrates a further embodiment of a plate resonator employed as a wall element or an element suspended in the room, e.g., as a front.

Further advantageous embodiments of the invented component are depicted in FIGS. 14, 15 and 16. FIG. 14*a* shows the plate resonator according to FIG. 4. FIG. 14*b* shows that a resilient foam layer 101 is disposed in the sound direction before the front plate 1, with the front plate and the layer being joined using whole surface adhesion 102. FIG. 14*c* shows another possibility, wherein the use of another, thin front plate 103, which is designed exactly like front plate 1, is joined to the resilient foam layer 101 using a whole surface adhesion 104. FIG. 14*d* shows another variant, application of another layer of resilient foam to front plate 103 using an adhesion 106. Resilient foam layers 101 and 105 are especially advantageous for absorption at high frequencies. The embodiment according to FIG. 14*c* has the effect that the second plate acts as an additional mass and the resilient foam layer 101 as an additional spring. The resilient foam layers can be designed of varying thickness in order to absorb the sound at different frequencies.

Another especially advantageous use of the fundamental idea of the present invention is particularly advantageous for large halls or rooms with high ceilings. In buildings of this type, e.g. conference rooms and factory halls, the ceiling is artificially lowered and/or suspended at a height. Therefore in industrial buildings, the ventilation ducts, electrical and/or pneumatic lines or conduits are placed below the ceiling.

FIG. 15*a* shows the plate resonator for uses of this type. For this reason, the plate resonator has on the rear side of rear board 2, a thin plate 1*a* analogous to the front plate 1 such that the resonator vibrates with the masses of both plates 1 and plate 1*a* with the spring 2 lying between them, and with both plates 1 and 1*a* vibrating against each other, as they also do according to FIG. 14*c*. The plate resonator according to FIG. 15*a* is suspended from the ceiling 5 using suspensions 18. It is useful if the suspensions 18 are designed to have a variable length like those used with common false ceilings.

Figure 14A:
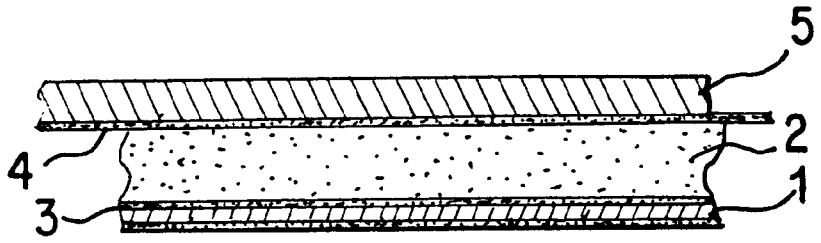
FIGS. 14*a*–14*d* illustrate another variant of the plate resonator as in FIG. 4 with an additional high-resilient foam layer, with an additional plate 103 on top of the high-resilient foam layer 101, and with another high-resilient foam layer 105 on top of the plate 103.
Figure 14B:
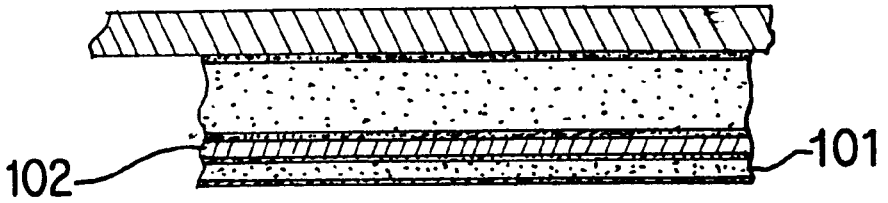
Figure 14C:
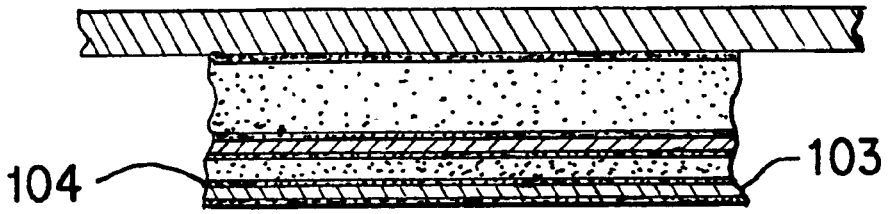
Figure 14D:
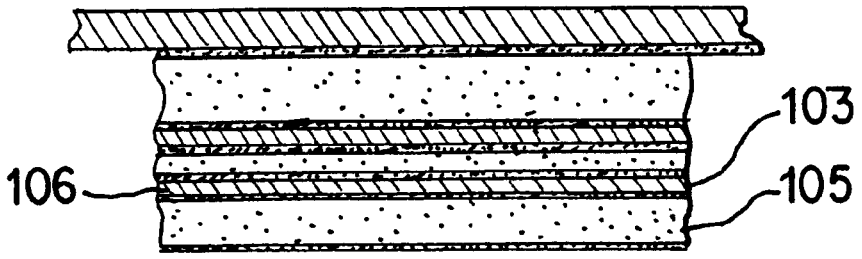

In FIG. 15*b*, the plate resonator is additionally equipped with a resilient foam layer 101 analogous to FIG. 14*b*. FIG. 15*c* shows another possible use of the plate resonator wherein the plate resonator is not attached to a rigid ceiling or rear wall. In this case, the plate resonator floats in a trough 110, e.g. made of metal or plastic., with the trough having large surface holes with a hole/surface ratio >30%. The trough 110 is arranged below the ceiling on beams 111. FIG. 15*d* depicts a variant of FIG. 15*c*, in which the plate 1*a* rests on trough 110 and the resilient foam layer 101 lies floating in the trough 110. FIG. 15*d* shows, in addition, a non-woven cover 120 between the plate resonator and the trough 110 for better handling.

FIG. 16 shows the plate resonator as a sound absorber with a two mass/spring system which is effective on both sides. The rear board 2*a* is disposed between plates 1*b* and 1*c* and resilient foam layers 101 are mounted on these plates 1*b* and 1*c* on the respective other side. The resilient foam layer, as well as the plate and rear board 2*a*, are joined using large surface adhesions and form a sandwich structure. This sound absorber can be enveloped by a non-woven cover 120 and can be suspended by means of a trough or a border 110. This arrangement is useful for rooms with high ceilings. This sound absorber can also be employed if rooms of normal height and can be constructed, for example, as a wall element or room partition. The trough or the border 110 should, in this event, be acoustically decoupled from the floor and/or, from a floor covering.

However the plate resonator does not only operate as an absorber (sound damper) but also as acoustical insulation for the rooms above it, in FIG. 15, or the adjacent rooms if employed as a wall element or a room partition.

We claim:

1. A plate resonator for acoustical damping and sound insulation of air-born sound, comprising:

a thin metal front plate;

a rear polymer board having a thickness;

a whole surface firm adhesive connection between said front plate and said rear board;

a lateral border closed on all sides by said rear board, said border not impeding lateral entry of the air-born sound into said rear board; and wherein the thickness of the rear polymer board is sufficient to allow absorption of the air-born sound at low and mid frequencies.

2. The plate resonator according to claim 1, wherein said rear polymer board is one of a polyurethane and polyethylene rear board, and wherein said whole surface firm adhesive connection is provided by a double-faced adhesive tape.

3. The plate resonator according to claim 1, further comprising a room surface, said rear board being attached to said room surface by adhesion.

4. The plate resonator according to claim 3, wherein said room surface is one of a ceiling and wall.

5. The plate resonator according to claim 1, further comprising edge mountings for attaching said plate resonator to a room surface.

6. The plate resonator according to claim 5, wherein said front plate and said rear board are attached to said edge mountings via one of adhesion, screw, and plug-in connections.

7. The plate resonator according to claim 1, wherein said plate resonator is mounted to a room surface in a detachable manner.

8. The plate resonator according to claim 1, wherein said rear board is made of a flame retardant or non-flammable melamine resin foam having a density of about 10 kg/m$^3$ and a thickness in a range of 50–500 mm.

9. The plate resonator according to claim 8, wherein said thickness is 100 mm.

10. The plate resonator according to claim 1, wherein said front metal plate is a steel plate having a plate thickness of 0.1–5 mm.

11. The plate resonator according to claim 10, wherein said plate thickness is 1 mm.

12. The plate resonator according to claim 1, further comprising a high-resilient foam layer placed before said front plate.

13. The plate resonator according to claim 12, further comprising a thin plate made of one of metal and hard plastic, said thin plate being placed on the high-resilient foam layer.

14. The plate resonator according to claim 13, wherein said high-resilient foam layer is placed on said thin plate.

15. A plate resonator for acoustical damping and sound insulation of air-born sound, comprising:

a thin metal front plate;

a rear polymer board;

a whole surface firm adhesive connection between said front plate and said rear board having a thickness;

a lateral border closed on all sides by said rear board, said border not impeding lateral entry of sound into said rear board;

a cover plate connected to said rear board via a whole surface connection;

a suspension system by which said plate resonator is suspended from a ceiling; and wherein the thickness of the rear polymer board is sufficient to allow absorption of the air-born sound at low and mid frequencies.

16. The plate resonator according to claim 15, further comprising a trough in which said plate resonator is disposed, said trough having a mounting mechanism.

17. The plate resonator according to claim 16, wherein said mounting mechanism allows said trough to lie on beams of a room surface.

18. The plate resonator according to claim 16, wherein said trough and said plate resonator contained therein are decoupled in an acoustical manner from a bearing surface.

19. The plate resonator according to claim 15, further comprising a non-woven cover for at least partially covering said plate resonator.

20. A wall element for acoustical damping and sound insulation of air-born sound, comprising:

a plate resonator comprised of:

a thin metal front plate;

a rear polymer board having a thickness;

a whole surface firm adhesive connection between said front plate and said rear board;

a lateral border closed on all sides by said rear board, said border not impeding lateral entry of sound into said rear board; and wherein the thickness of the rear polymer board is sufficient to allow absorption of the air-born sound at low and mid frequencies.

21. The wall element according to claim 20, wherein said wall element is suspended in a room or is a room partition.

* * * * *